US008196420B2

(12) United States Patent
Ericsson

(10) Patent No.: US 8,196,420 B2
(45) Date of Patent: Jun. 12, 2012

(54) EXPANSION VALVE CONTROL FOR ENHANCING REFRIGERATOR EFFICIENCY

(76) Inventor: Svenning Ericsson, Torslanda (SE)

( * ) Notice: Subject to any disclaimer, the term of this patent is extended or adjusted under 35 U.S.C. 154(b) by 782 days.

(21) Appl. No.: 11/915,899

(22) PCT Filed: Jun. 12, 2006

(86) PCT No.: PCT/SE2006/000680

§ 371 (c)(1),
(2), (4) Date: Nov. 29, 2007

(87) PCT Pub. No.: WO2006/135310

PCT Pub. Date: Dec. 21, 2006

(65) Prior Publication Data

US 2009/0314014 A1 Dec. 24, 2009

(30) Foreign Application Priority Data

Jun. 13, 2005 (SE) ..... 0501354
Mar. 13, 2006 (SE) ..... 0600539

(51) Int. Cl.
*F25B 39/04* (2006.01)

(52) U.S. Cl. ..... 62/183

(58) Field of Classification Search ..... 62/183, 62/210, 218, 222–223, 513, 129, 216, 238.6, 62/498, 527, 528; 236/92 B
See application file for complete search history.

(56) References Cited

U.S. PATENT DOCUMENTS

| | | | | | |
|---|---|---|---|---|---|
| 1,829,517 | A | * | 10/1931 | Hilger | 62/218 |
| 2,669,849 | A | * | 2/1954 | Lange | 62/225 |
| 3,264,837 | A | * | 8/1966 | Harnish | 62/117 |
| 3,304,738 | A | * | 2/1967 | Armstrong | 62/218 |
| 4,573,327 | A | | 3/1986 | Cochran | |
| 4,735,059 | A | | 4/1988 | O'Neal | |
| 4,806,135 | A | * | 2/1989 | Siposs | 96/212 |
| 5,417,078 | A | * | 5/1995 | Huenniger et al. | 62/218 |
| 5,813,248 | A | * | 9/1998 | Zornes et al. | 62/480 |
| 6,105,379 | A | * | 8/2000 | Alsenz et al. | 62/225 |
| 6,164,081 | A | * | 12/2000 | Jensen et al. | 62/115 |
| 6,782,713 | B2 | * | 8/2004 | Takeuchi et al. | 62/500 |
| 2001/0020365 | A1 | * | 9/2001 | Kubo et al. | 62/1 |
| 2005/0066674 | A1 | * | 3/2005 | Hirota et al. | 62/222 |

FOREIGN PATENT DOCUMENTS

GB 898327 A 6/1962

* cited by examiner

*Primary Examiner* — Frantz F. Jules
*Assistant Examiner* — Lukas Baldridge
(74) *Attorney, Agent, or Firm* — David A. Guerra

(57) ABSTRACT

The present invention concerns a cooling or heating system including at least a compressor, a condenser, an expansion apparatus and a vaporizer. The invention is characterized essentially in that in the condenser or in proximity to an outlet of the condenser and before inlet to the expansion apparatus there is a control apparatus arranged to receive condensate-liquid and an intake to a signal channel, and that there is an arrangement to vaporize condensate liquid in the signal channel. An orifice reduces signal channel flow when this flow enters into the cooling or heating system low-pressure side form the signal channel the amount of liquid that is vaporized in the signal channel affects the expansion apparatus connected to the signal channel and the expansion apparatus opening process.

19 Claims, 4 Drawing Sheets

EXPANSION VALVE CONTROL FOR ENHANCING REFRIGERATOR EFFICIENCY

CROSS-REFERENCE TO RELATED APPLICATIONS

This application is an U.S. national phase application under 35 U.S.C. §371 based upon co-pending International Application No. PCT/SE2006/000680 filed on Jun. 12, 2006. Additionally, this U.S. national phase application claims the benefit of priority of co-pending International Application No. PCT/SE2006/000680 filed on Jun. 12, 2006, Sweden Application 0600539-1 filed on Mar. 13, 2006, and Sweden Application No. 0501354-5 filed on Jun. 13, 2005. The entire disclosures of the prior applications are incorporated herein by reference. The international application was published on Dec. 21, 2006 under Publication No. WO 2006/135310 A1.

TECHNICAL FIELD

The present invention concerns a cooling or heating apparatus including at least a compressor, a condenser, an expansion apparatus and a vaporiser.

The invention also concerns a method for controlling a cooling or heating apparatus including at least a compressor, a condenser, an expansion apparatus and a vaporiser.

The invention will be applied to cooling and heating systems with vaporising/condensing coolants as the working medium. The system according to the invention can be applied to all types of cooling system such as air-conditioning, heat pumps, process and apparatus cooling systems that use a piston compressor, screw compressor, scroll compressor, centrifugal compressor, rotation compressor or some other type of compressor and all types of coolants for heat exchange via vaporization/condensation.

State of the Art

On the market there are different system for regulating and controlling cooling and heating. However, the systems that are used are often complicated and require a large volume and are thereby needlessly expensive. The size and complexity of the systems also means that the control speed and effectiveness is lower than expected. Some previously known systems that have some of the above mentioned disadvantages will be described briefly below.

U.S. Pat. No. 4,566,288 and GB-A-659,051 concern different float systems that either affect a valve directly or affect a valve indirectly via electric impulses and send signals to a valve for condensate outflow. These systems are both complicated and controlled with the help of electric impulses and are thereby not self-actuating, and they are large and voluminous with a valve connected to a float for controlling the whole amount of condensate.

U.S. Pat. No. 3,388,558 and EP-A-0,939,880 concern systems with thermostat valves that with the help of electrical heating of the system's thermal part affect a membrane that on pressure increase opens a valve. Neither are these system self-actuating since the control impulse consists of electric resistances for heating a bulb with an external modulation control signal for heating.

U.S. Pat. No. 5,156,017 shows a temperature controlled system that controls the flow with the help of the temperature difference between the exit condensate's supercooling and the condensation temperature. However, these controls do not make full utilization of the condenser surfaces possible since a supercooling loop is required in order to control the exit condensate.

U.S. Pat. No. 3,367,130 concerns a system with a traditional thermostatic expansion valve that controls the difference between the vaporisation temperature and overheated gas after the vaporiser with the help of impulses from a gas filled thermosensitive sensor. The system is controlled via overheating gas after vaporization which means that the control impulse for the expansion valve can affect the temperature difference between the coolant and the heat emitting medium negatively.

U.S. Pat. No. 4,267,702 concerns systems with a pressure sensitive valve that entirely or partly turn the liquid supply off depending on the pressure difference between operation and stop. However, the systems do not control condensate outflow depending on uncondensed gas. The control function is thus not affected by condensate quality.

There is thus a need of a system that in a simple, smooth and easy way solves the problems with the above mentioned systems.

DESCRIPTION OF THE INVENTION

A purpose of the present invention is to solve the problem that gas in the condensate causes unnecessary power losses.

Another purpose of the invention is to solve the problem of controlling the liquid flow from the condenser so that uncondensed gas does not pass by the condenser control.

According to a specific embodiment a purpose of the invention is to solve the problem of recycling supercooling heat without decreasing the condenser's condensing power.

According to a first preferred embodiment a purpose of the invention is to solve the problem of controlling the liquid flow with the help of pressure impulses to already known valve constructions.

According to an alternative embodiment a purpose of the invention is to give a solution to the problem of controlling the liquid flow in the cooling system/heat pump system with a float valve for signal flow to an expansion valve.

A specific purpose of the invention is to control liquid flow in such a way that the system is self-actuating without needing external, for instance electric, control apparatus.

Finally, a purpose of the invention is to solve the problem of providing a vaporiser surface with coolant without needing to overheat suction gas for controlling the flow.

Said purposes are achieved with a cooling and heating apparatus as given in the characterising portions of patent claims 1 and 14 and the dependent claims belonging to them.

BRIEF DESCRIPTION OF THE FIGURES

The invention will be described in the following in a non-limiting way and for illustrative reasons with reference to the attached figures in which.

DETAILED DESCRIPTION OF THE INVENTION

Figure 1:
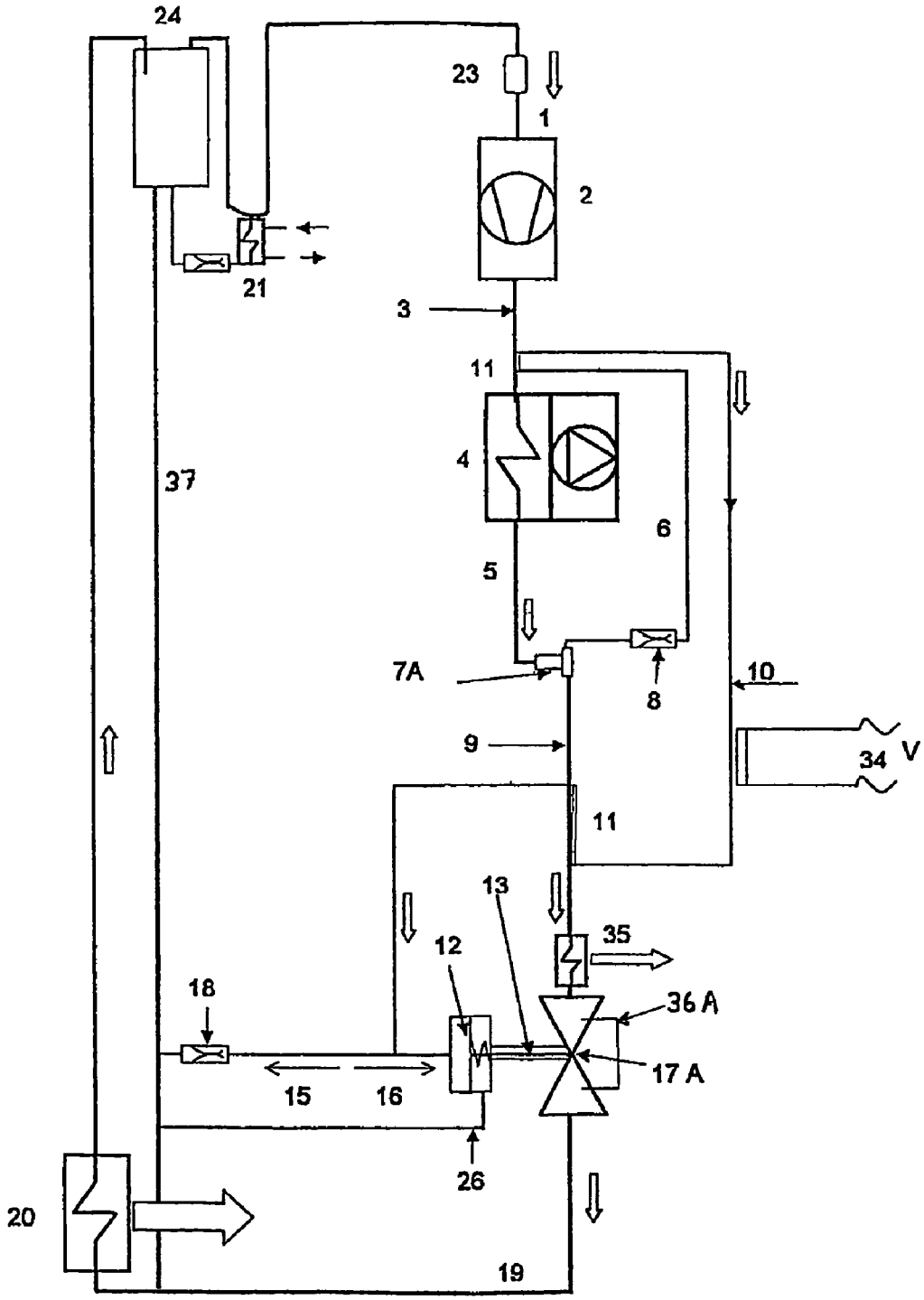
FIG. 1 shows a control system according to a preferred embodiment according to the present invention.

FIG. 1 shows a system for thermal, cooling, or freezing systems. The system consists of channels containing coolant (not shown), a compressor 2, a condenser 4, an expansion valve 17A, a vaporiser 20, a liquid separator 24, an oil return apparatus 21, an accumulator 23 and a device 7A for detection of the presence of gas bubbles intended to control an expansion valve 17A.

Figure 6:
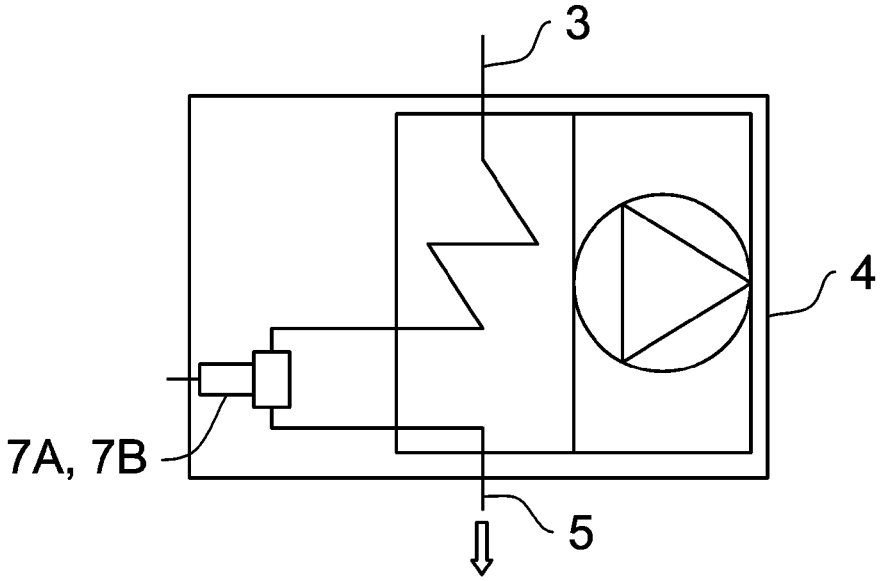
FIG. 6 shows an alternative placement of a control apparatus.

When the expansion valve 17A opens condensed coolant flows to the system's low pressure side 19 where the medium expands. Thereafter the medium flows further to a vaporiser 20 where heat uptake to coolants takes place from gas, usually air, or liquid, whereby the coolant liquid vaporises. The gas/liquid mixture is then pressured to a liquid separator 24 where liquid is separated from gas. With the help of gravitation some of the liquid is made to pass through a heat exchanger where oil and coolant liquid are separated, after which oil is returned to the compressor 2 via the accumulator 23 and a suction line 1. Return of liquid that has not been vaporised takes place from the liquid separator 24 via channel to the vaporiser 20. The compressor 2 compresses the coolant that is thereafter cooled in the condenser 4 where condensation takes place. In FIG. 6 an alternative embodiment form is shown where the control apparatus 7A is placed in the condenser in front of its outlet.

Figure 2:
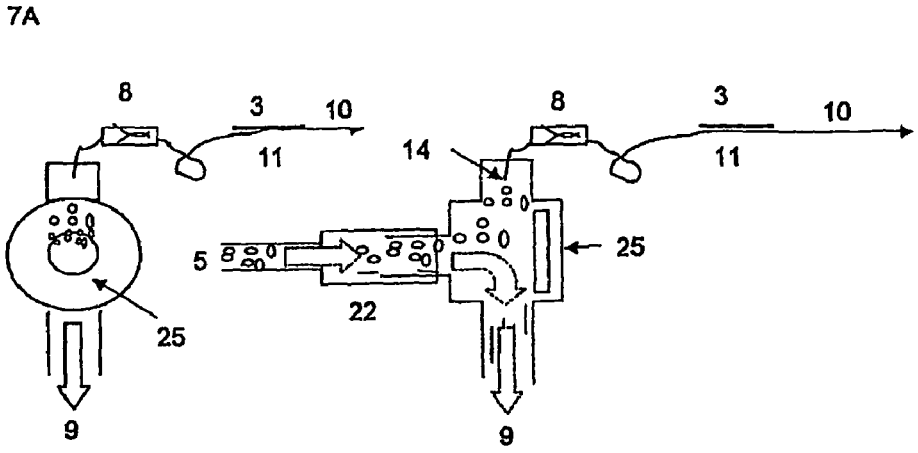
FIG. 2 shows a device for detection of gas bubbles according to the present invention.

In FIG. 2 a device 7A is shown according to a preferred embodiment that is provided with a drying filter 22 and inspection glass 25. As not all the gas condenses on passage through the condenser 4 there can still be gas bubbles left in the coolant. The device 7A separates the gas that has not condensed directly inside the inspection glass 25 so that the control process with separation of gas bubbles can be seen. During compressor operation gas flows via the signal channel opening 14 through an orifice 8 into a signal channel 6. The gas then passes a heat exchanger 11 after which the signal channel 6 changes into in a signal channel 10. An electrical heater can possibly be coupled to the signal channel 10. The gas gives rise to a pressure change that affects an expansion valve 17A membrane 12 attached to the signal channel 10. Pressure changes that affect the membrane 12 in turn affect a mechanism 13, for instance a piston, whereby the expansion valve opening is controlled. An orifice 18 that on its output side is connected to the cooling system's low pressure side 37 is also arranged in proximity to said channel 10. Depending on the gas pressure that the gas flowthrough produces gas flows out through the orifice 18. This gives the space in front of the membrane 12 a pressurisation that is higher than the reference pressure in the space behind the membrane 12 attached to the low pressure side 37 via a compensation channel 26.

When liquid, that is to say condensate, enters the inlet to the signal channel 14 it must pass the orifice 8, whereby an expansion occurs and the fluid vaporises because of the pressure reduction that the orifice 8 entails. The liquid gas mixture that is formed in the signal channel 6 after the orifice 8 then vaporises additionally in one of the heat exchanger apparatuses 11, 34. During vaporisation a volume increase occurs and essentially all the liquid changes into gas form. Thereafter the gas is led further in the channel 10 to a pressure sensitive expansion valve 17A that with the help of a mechanism 13 is made to open 16 whereupon the gas is pressured via the orifice 18 to the cooling/heat pump system's low pressure side 37.

When gas or gas mixed liquid instead of pure liquid enters the inlet to the signal channel 14 a smaller volume increase occurs than when pure liquid enters according to the above. The pressure in the signal channel 10 is affected thereby which also makes the valve's mechanism 13 close. If the mechanism 13 closes the flow through the valve 17A is shut off for the condensate that flows through the condensate channel 9 that comes from the device 7A. The orifice 8 has a smaller flowthrough capacity than the orifice 18 which means that even a small amount of uncondensed coolant can give the expansion valve 17A an open impulse.

The orifice 18 maintains a higher pressure from the high pressure side relative to the low pressure side in order to make a signal to the expansion valve possible.

A channel 36A is arranged parallel to the expansion valve 17A. When the valve is closed a signal flow is obtained through the valve so that a faster impulse can occur to the signal channel's 6 intake 14 after the cooling system is started up.

Figure 3:
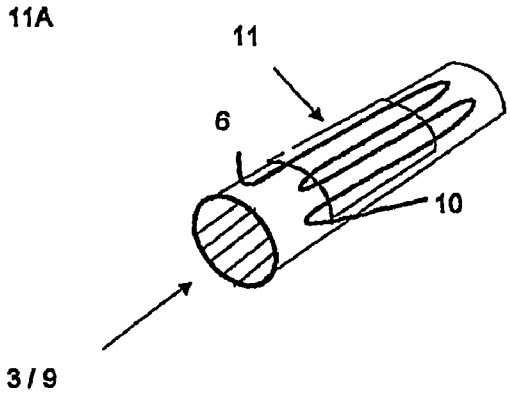
FIG. 3 shows a heat exchanger according to the present invention.

In FIG. 3 a heat exchanger 11 for vaporization of liquid that flows through the signal channel 6, 10 is shown. The channel 6, 10 preferably has an outside diameter of about 3 millimeters and is attached to a channel 3, 9, preferably in a loop, containing hot gas or condensate, respectively, in order to achieve as large a heat exchange as possible.

Figure 4:
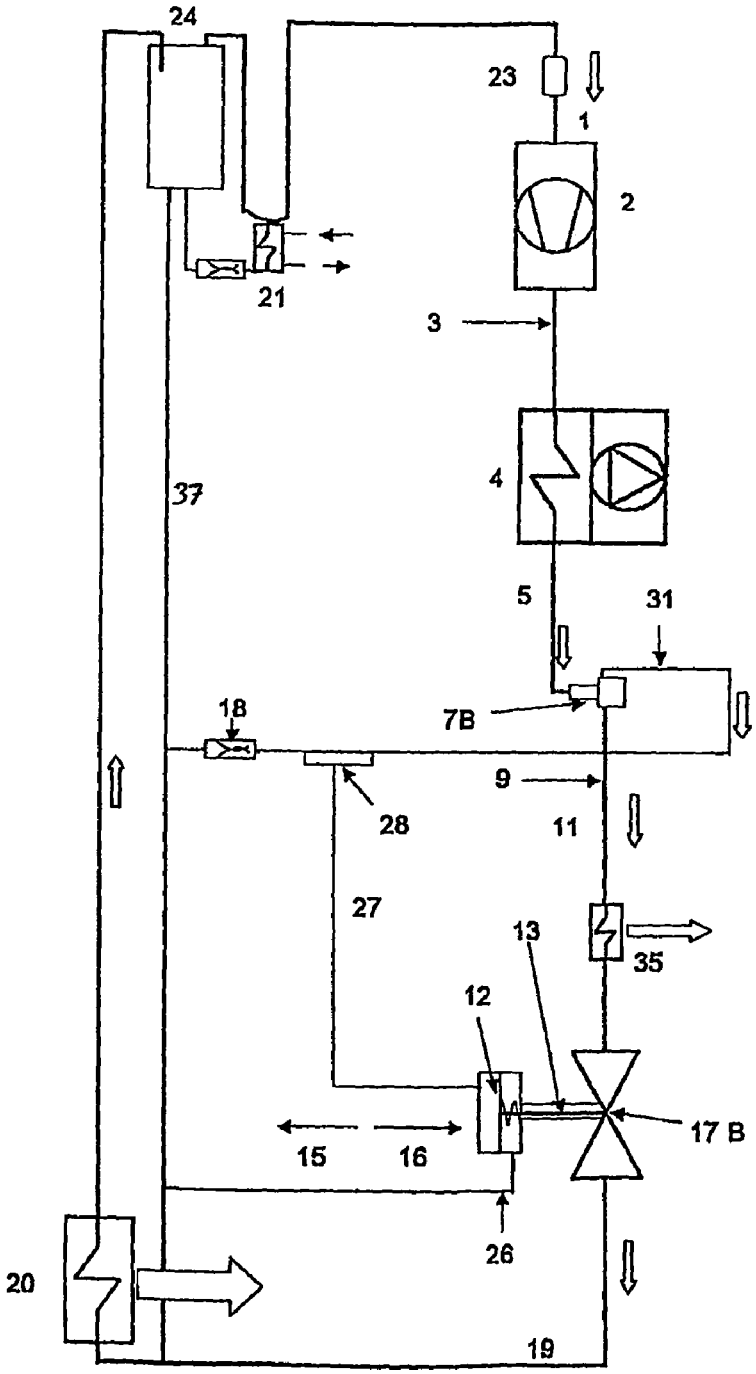
FIG. 4 shows a control system according to an alternative embodiment according to the present invention.
Figure 5:
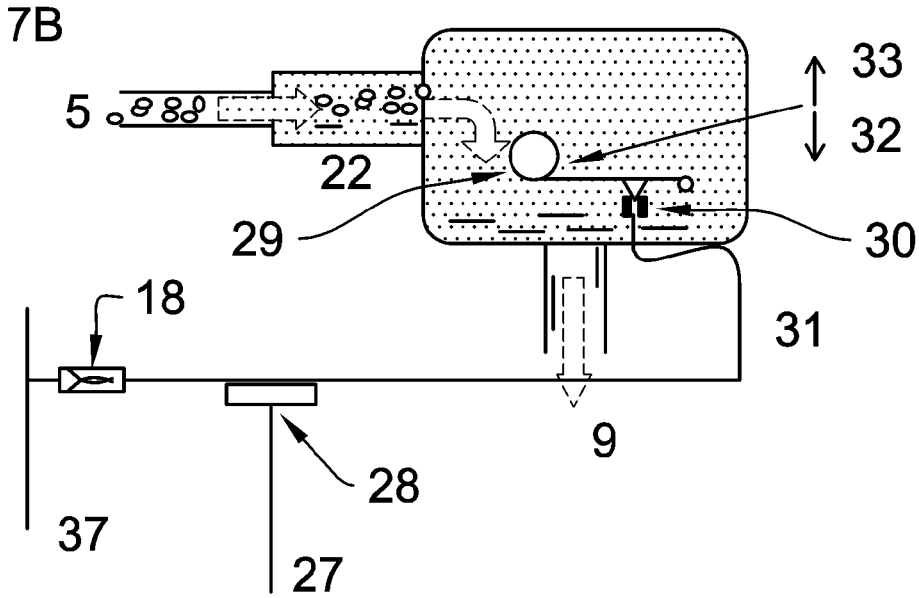
FIG. 5 shows a float apparatus according to the present invention.

In FIG. 4 a control system according to an alternative embodiment according to the present invention is shown. Instead of device 7A that is used for detection of the presence of gas bubbles according to the embodiment shown in FIG. 1, a float apparatus 7B shown in FIG. 5 is used in this embodiment. Via a signal channel 31, a temperature sensitive sensor 28 and a signal channel 27 the float apparatus 7B gives control impulses to a thermostatic expansion valve 17B.

For sufficient supply of condensate from the condenser 4 a float 29 is raised 33 and a valve 30 is opened, whereby liquid flows into a signal channel 31. An orifice 18 situated between the signal channel's 31 inlet valve 30 and the system low pressure side 37 is adjusted to the valve's 30 flow capacity relative to the orifice 18 in such a way that a temperature increase occurs in the signal channel 31 and in the sensitive element 28 when the flow of coolant through the valve 30 is strong enough. The orifice 18 is adjusted for a smaller flowthrough than the inlet valve 30 as this valve is fully open. Here the orifice 18 maintains a higher temperature on the high pressure side relative to the low pressure side's temperature.

When the coolant flow through the signal channel 31 exceeds a certain level the orifice 18 cannot pass a sufficient quantity of coolant to allow sufficient vaporization of coolant from the liquid phase to the gas phase to take place in the signal channel 31 for which reason the temperature in this channel 31 increases which leads to the expansion valve's 17B being opened.

When the inlet valve 30 is not required to be open and thereby does not provide a sufficient liquid supply to the signal channel 31 vaporization occurs in the signal channel 31 that is enough to lower the temperature in said channel 31. The sensitive element 28 for the thermostatic expansion valve 17B registers the temperature reduction which entails a reduction in steam pressure in the space over the bellows membrane 12. This pressure reduction leads to the membrane 12 giving the expansion valve 17B mechanism 13 an order to close, whereby the flow through the expansion valve 17B decreases.

The system according to FIG. 4 can also by supplied with a heater or the like in order to vaporize liquid present in the signal channel 31 even if that is not required.

The system according to the invention provides a cooling/heating system that is simple and inexpensive and provides fast control.

The invention results in a small quantity of condensate from the valve 30 being able to control a much larger quantity of condensate via the expansion valve 17B.

Of course the invention is not limited to the embodiments described above and illustrated in the attached drawings.

Modifications are feasible, especially concerning the different parts' nature, or through using comparable techniques, without departing from the protected area given in the patent claims because of them.

Reference Symbols

1 Suction line gas without liquid admixture.
2 Compressor
3 Hot gas channel
4 Condenser for removal of heat. In contact with air or liquid.
5 Condensate channel
6 Signal channel after orifice 8 before heating 11.
7A Device for control of the presence of gas bubbles.
7B Float and float housing with valve.
8 Orifice
9 Condensate channel
10 Signal channel
11 Heat exchanger
12 Pressure membrane
13 Piston affected by a membrane and controlling the expansion valve 17.
14 Intake to signal channel 6, 10
15 Closing function
16 Open function
17A Expansion valve
17B Thermostatic expansion valve
18 Orifice
19 Expansion channel, low pressure side.
20 Vaporiser for heat uptake.
21 Oil return from liquid separator with heat for vaporization of coolant.
22 Drying filter
23 Accumulator
24 Liquid separator
25 Inspection glass
26 Signal channel, compensation channel.
27 Signal channel to expansion valve.
28 Thermal bulb/sensor
29 Float body
30 Valve affected by the float 29.
31 Signal channel between the float valve and the orifice 18.
32 Valve closes at low liquid level.
33 Valve opens at high liquid level.
34 Electric heating
35 Heat exchanger for liquid supercooling/heat recovery from condensate.
36A Signal flow past expansion valve.
37 Low pressure side

The invention claimed is:

1. A cooling or heating system for controlling the liquid flow to reduce power losses, said cooling or heating system comprising:

at least one compressor;

a condenser in communication with said compressor;

an expansion apparatus in communication with said condenser by a condensate channel;

a vaporizer in communication with said expansion apparatus and said compressor;

a control apparatus in said condenser or in proximity to an outlet of said condenser before said expansion apparatus, said control apparatus being arranged to receive liquid from said condenser, said control apparatus having an inlet to an impulse-signal channel, said impulse-signal channel having at least one vaporize arrangement to vaporize liquid that comes into said impulse-signal channel, said vaporize arrangement provides at least a heat-exchange between said condensate channel and said impulse-signal channel;

an orifice arranged in said impulse-signal channel and after said vaporize arrangement, said impulse-signal channel being connected to a cooling or heating system low-pressure side, said orifice reduces an impulse-signal flow entering said low-pressure side for maintaining a higher pressure in said impulse-signal channel from a high pressure side relative to said low pressure side by depending on pressure produced by an amount of said liquid that is vaporized in said impulse-signal channel and said impulse-signal flow from said impulse-signal channel to said low pressure side; and a control for controlling an opening and closing process of said expansion apparatus, said control being connected to said impulse-signal channel;

wherein the amount of liquid that vaporizes in said impulse-signal channel affects the pressure in said impulse-signal channel, and wherein the pressure in said impulse-signal channel affects said control for controlling said opening and closing process of said expansion apparatus.

2. The cooling or heating system according to claim 1, wherein a second orifice is arranged in proximity to said inlet of said impulse-signal channel in order to achieve a pressure reduction and thereby vaporize the liquid present.

3. The cooling or heating system according to claim 2 further comprising an electric heat supply apparatus configured to vaporize said liquid present in said impulse-signal channel.

4. The cooling or heating system according to claim 3, further comprising pipes being at least one loop attached to said impulse-signal channel to exchange heat therebetween, and said loop being substantially along a longitudinal axis of said condensate channel, wherein said pipes contain at least one of hot gas, and condensate for vaporization of liquid that flows through said impulse-signal channel.

5. The cooling or heating system according to claim 4, wherein an output to the condensate channel from said control apparatus is situated below said inlet, and that said inlet to said impulse-signal channel from said control apparatus is so situated that gas bubbles that occur in the condensate are led into said inlet of said impulse-signal channel from the condensate.

6. The cooling or heating system according to claim 5, wherein said control apparatus is provided with an inspection glass in order to enable observation of the separation of gas bubbles.

7. The cooling or heating system according to claim 6 further comprising a second pipe arranged parallel to said expansion apparatus, said second pipe maintains a signal flow to control apparatus inlet to said impulse-signal channel past said expansion apparatus when said expansion apparatus is closed.

8. The cooling or heating system according to claim 1, wherein the amount of liquid that is vaporized in said impulse-signal channel affects the temperature in said impulse-signal channel, and that said control for said opening and closing process of said expansion apparatus is affected by the temperature in said impulse-signal channel.

9. The cooling or heating system according to claim 8, where in said control apparatus further comprising a float arranged to control said inlet to said impulse-signal channel from said control apparatus.

10. The cooling or heating system according to claim 8 further comprising a thermal bulb/sensor arranged in or in proximity to said impulse-signal channel in order to measure the temperature in said impulse-signal channel for controlling said opening process of said expansion apparatus comprising a pressure member, said thermal bulb/sensor being in communication with said expansion apparatus via a signal channel.

11. A cooling or heating system comprising:

at least one compressor;

a condenser in communication with said compressor, via a hot gas channel;

an expansion apparatus in communication with said condenser;

a vaporizer in communication with said expansion apparatus;

a liquid separator in communication with said vaporizer;

an oil return apparatus in communication with said liquid separator and said compressor;

a control apparatus in said condenser or in proximity to an outlet of said condenser, said control apparatus being arranged to receive liquid from said condenser, said control apparatus having an outlet to a condensate channel, said condensate channel is connectable to said expansion apparatus;

a signal channel having an inlet in communication with said control apparatus, said signal channel being in heat exchange contact with at least said condensate channel, said signal channel then being in communication with at least said expansion apparatus, wherein said heat exchange contact vaporizes an amount of liquid that comes into said signal channel to control an opening process of said expansion apparatus, wherein said control is affected by the amount of liquid vaporized in said signal channel;

a float arranged to control said inlet to said signal channel from said control apparatus, said float having a float body operatively connected to a valve, said valve being connected to said signal channel for controlling flow of the liquid into said signal channel;

a sensor arranged in or in proximity to said signal channel in order to measure the temperature in said signal channel;

an orifice arranged after said sensor between said signal channel and the system's low pressure side, said orifice being adapted to reduce the flow of the liquid; and a pressure membrane connected to said signal channel for controlling said opening process of said expansion apparatus.

12. The cooling or heating system according to claim 11, wherein the amount of liquid that is vaporized in said signal channel affects the temperature in said signal channel and that said control of the opening process is affected by the temperature in said signal channel.

13. The cooling or heating system according to claim 2, wherein said vaporize arrangement being at least a first and second vaporize arrangement, said first vaporize arrangement being located on said hot gas channel between said compressor and said condenser, and said second vaporize arrangement being located on said condensate channel between said expansion apparatus and said control apparatus.

14. The cooling or heating system according to claim 13, wherein said first and second vaporize arrangements are looped pipes for exchanging heat from said impulse signal channel to said hot gas channel and said condensate channels, respectively, said loops being substantially along a longitudinal axis of said condensate channels respectively.

15. The cooling or heating system according to claim 14, wherein said orifice arranged in proximity to said inlet of said impulse-signal channel is located between said control apparatus and said first vaporize arrangement.

16. The cooling or heating system according to claim 15, wherein said electric heat supply apparatus is located between said first and second vaporize arrangements.

17. The cooling or heating system according to claim 16 further comprising a pipe arranged parallel to said expansion apparatus, said pipe maintains a signal flow to a control apparatus inlet to said impulse-signal channel past said expansion apparatus when said expansion apparatus is closed.

18. The cooling or heating system according to claim 1, wherein said control apparatus detects any presence of gas bubbles and is configured to control said expansion apparatus, and wherein said control apparatus further comprising a drying filter and an inspection glass, said control apparatus separates said gas bubbles that have not condensed directly inside said inspection glass so that said gas bubbles can be observed.

19. The cooling or heating system according to claim 1, wherein said control apparatus further comprising a drying filter, a float, and a valve operatively connected to said float, said valve being in communication with said inlet of said impulse-signal channel.

* * * * *